United States Patent [19]

Blumenthal et al.

[11] 3,949,562

[45] Apr. 13, 1976

[54] APPARATUS FOR PREVENTING CAVE-INS OF EXCAVATIONS

[75] Inventors: Günter Blumenthal, Westerholt; Ernst Gebehart, Bochum, both of Germany

[73] Assignee: Bochumer Eisenhutte Heintzmann & Co., Bochum, Germany

[22] Filed: June 6, 1974

[21] Appl. No.: 477,084

[30] Foreign Application Priority Data

June 20, 1973 Germany ..... 2331309

[52] U.S. Cl. ..... 61/45 D

[51] Int. Cl.[2] ..... E21D 15/44

[58] Field of Search ..... 61/45 D; 299/31, 33

[56] References Cited

UNITED STATES PATENTS

| | | | |
|---|---|---|---|
| 3,482,878 | 12/1969 | Flöter | 61/45 D X |
| 3,490,243 | 1/1970 | Groetschel | 61/45 D |
| 3,811,288 | 5/1974 | Wehner et al. | 61/45 D |

FOREIGN PATENTS OR APPLICATIONS

| | | | |
|---|---|---|---|
| 2,013,634 | 11/1970 | Germany | 61/45 D |

*Primary Examiner*—Paul R. Gilliam
*Assistant Examiner*—David H. Corbin
*Attorney, Agent, or Firm*—Michael J. Striker

[57] ABSTRACT

An apparatus is disclosed for preventing cave-ins of mining galleries and other underground excavations. It includes a base, a roof-supporting shield extending upwardly from the base and a free edge to which a roof-supporting cap is pivoted, and an advancing arrangement for advancing the apparatus towards and away from a face of the excavation. The advancing arrangement has a shiftable carriage which can move towards and away from this face and which has an end directed towards the latter, and an extension section is telescopable into and out of this end and can be arrested in a plurality of different telescoped positions.

11 Claims, 4 Drawing Figures

APPARATUS FOR PREVENTING CAVE-INS OF EXCAVATIONS

BACKGROUND OF THE INVENTION

The present invention relates generally to an apparatus for preventing cave-ins of mining galleries and underground excavations, and in particular to an improvement of such an apparatus.

There are many instances where the roof of an underground excavation must be prevented from caving in; by way of example, the prior art and the present invention will be discussed hereafter with reference to the prevention of cave-ins in underground mining galleries.

Equipment already exists for preventing such cave-ins, so called mine roof supports having a base supported on the floor of the excavation, an upstanding shield which is connected with the base and rises upwardly from the same, and a pit prop of fixed or telescopic type by means of which the shield can be raised or lowered with reference to the base so as to accommodate the apparatus to excavations of different height. An example of this general type of apparatus can be found in U.S. Pat. No. 3,672,174, and another example can be found in U.S. Pat. No. 3,691,775. This type of equipment is provided with advancing means to make it possible for the entire apparatus to advance towards and away from the mine face, that is the face of the excavation where work is being performed, for example to remove coal or the like. Usually, such apparatus is used in conjunction with mining machinery which removes the coal or other material from the mine face, so that the coal can fall onto scraper conveyors or the like to be transported along the mine face and away from the operating station.

One type of mine roof support equipment uses a carriage located at the supporting base and being connected with a cylinder and piston unit which is also secured to the base itself, for instance which has its cylinder secured to the base and its piston rod secured to the carriage. The latter extends in direction substantially normal to the mine face and has a free end that can be releasably connected with the scraper conveyor or similar element, either directly or indirectly. This free end is located remote from the opposite end of the carriage which is connected with the piston rod, and the scraper conveyor or the like is located intermediate the end face and the base of the mine roof supporting apparatus. This means that when the cylinder and piston unit is operated to retract its piston and piston rod, the entire unit is shifted towards the mine face, due to the fact that the free end of the carriage is firmly held by the appropriately anchored conveyor.

In underground excavations, especially in mining galleries and the like, the height of the excavation varies frequently as the removal of material from the mining face progresses, for instance because a coal seam is of different height at different locations. It is important from the point of view of safety that the roof supporting apparatus be capable of being accommodated to these height variations as soon as they occur, for instance as soon as material is removed to a greater height at one spot than at a previous spot. In this respect however, problems have been encountered with the type of equipment known in the prior art, and particularly with a type of mine roof support which is constructed in the manner discussed earlier but wherein the roof supporting shield is provided, at its free edge that is located closest to the mine face, with a roof supporting cap that is pivoted to this free edge and bridges the spacing between the free edge and the mine face, which spacing corresponds approximately to the spacing between that edge of the base that is closest to the mine face, and the mine face itself. When the height of an excavation changes, for instance increases, and an apparatus of this type is adjusted by raising the shield and therefore the roof supporting cap, a difficulty is experienced which results from the manner in which this type of apparatus is constructed, namely that the edge of the roof supporting cap that is located closest to the mine face, and that should advantageously be located right at the mine face to leave no gap through which a break-in might occur, will immediately tilt downwardly away from the roof of the excavation. This means that the more the shield and the cap are raised, the more the free edge of the cap will move away from the mine face, thus forming with the same a gap which increases the more, the higher the shield and the roof supporting cap are raised. This brings with it the evident danger that in these regions where there is now no longer any support for the roof, the material of the roof might cave in.

The prior art has proposed to overcome this problem by providing the roof supporting cap itself with extensions that can be moved out of the cap towards the mine face in order to bridge the gap which develops. However, it has been found that this type of construction presents very significant difficulties in structural and technological respects. Such extensions are subjected to extremely high stresses since the upwardly directed supporting force of the pit prop or analogous device used for holding up the shield and the roof supporting cap against the downward action of the weight of the roof material, must be transmitted into these extensions and via the same to the roof material. This meant extremely complicated and expensive structural measures had to be taken, which greatly increased the expense of this type of apparatus.

SUMMARY OF THE INVENTION

In view of what has been set forth above, it is a general object of the present invention to provide an improvement in the type of apparatus under discussion.

More particularly, it is an object of the invention to provide an improved apparatus for preventing cave-ins of mining galleries and other underground excavations, which makes it possible to eliminate the formation of a gap between the free end of the roof supporting cap and the face of the excavation without having to resort to the aforementioned roof supporting cap extensions.

An additional object of the invention is to provide such an apparatus which is quite simple in its construction and therefore less expensive than those known from the prior art.

In keeping with the above objects, and with others which will become apparent hereafter, one feature of the invention resides in an apparatus for preventing cave-ins of mining galleries and other underground excavations, which includes base means, roof support shield means on the base means and extending above the same toward a face of the excavation, and advancing means including a shiftable carriage movable with the base means towards and away from the face and having an end directed towards the latter. The invention provides for an improvement which comprises an extension section that is telescopable into and out of the aforementioned end of the carriage, and arresting means for arresting the extension section in a plurality of different telescoped positions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
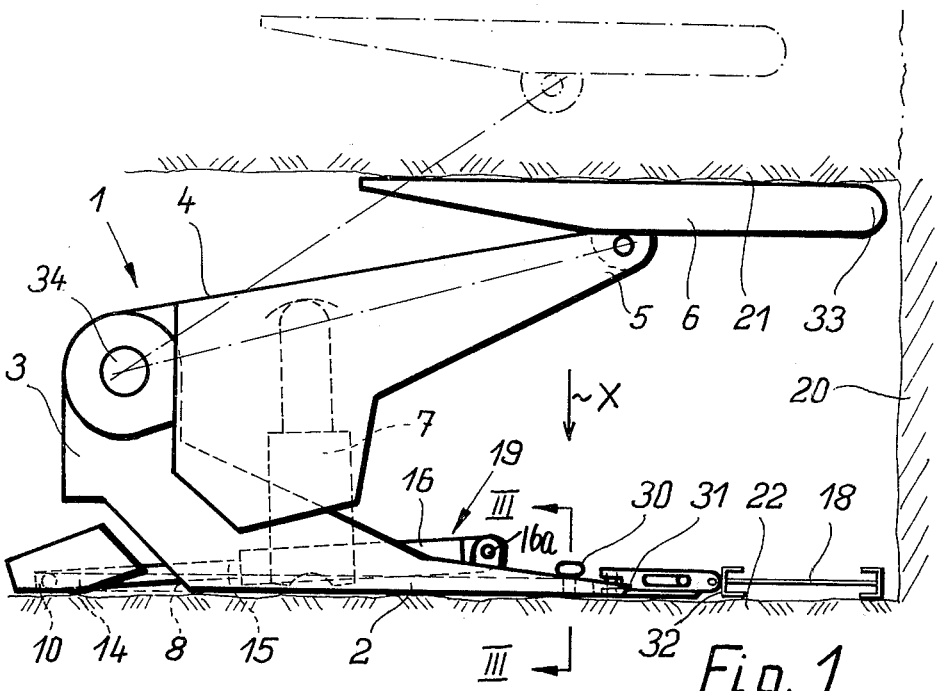
FIG. 1 is a somewhat diagrammatic side view illustrating an embodiment of the invention, installed in an underground excavation.
Figure 2:
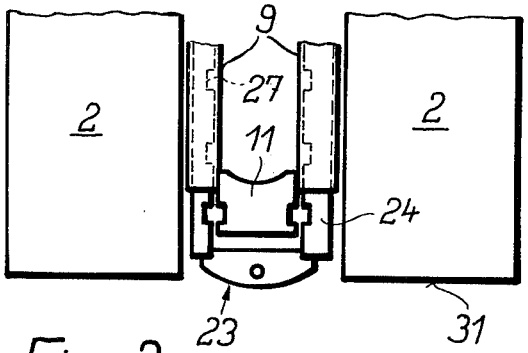
FIG. 2 is a fragmentary top-plan view of a portion of the embodiment in FIG. 1, as indicated by the arrow X of FIG. 1.
Figure 3:
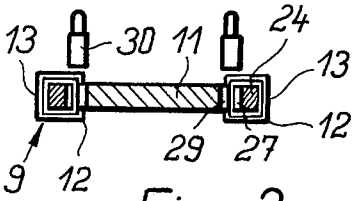
FIG. 3 is a section taken on line III—III of FIG. 1.

The exemplary embodiment illustrated in FIGS. 1–4 has a number of components which correspond to those known from the prior art. In particular, the apparatus in FIGS. 1–4 is identified in toto with reference numeral 1 and has a base 2 having a right-hand end that faces towards the mine face 20 from which material is to be removed in a manner not illustrated, and a left-hand end that faces away from the mine face 20. The left-hand end is identified with reference numeral 3 and mounted on it is a shield 4 which can pivot about the pivot axis 34. The right-hand free end portion 5 of the shield 4 has pivoted to it a roof supporting cap 6 which essentially bridges the gap between the end portion 5 (and also the right-hand end of the base 2) and the mine face 20. One or more (one shown) hydraulically operated pit props 7 are tiltably mounted between the base 2 and the shield 4, in a manner which has not been further illustrated as being known from the prior art, for instance from the aforementioned U.S. patents. The purpose of the pit prop 7 is, of course, to pivot the shield 4 upwardly or downwardly about the pivot axis 34. The entire apparatus may be composed of one, two or more laterally arranged units which can be connected with one another but operated independently of one another to permit requisite accommodation in the event that in the direction normal to the plane of FIG. 1 the excavation might not have a level floor, a level roof, or both. For purposes of explanation of the illustrated embodiment, it is assumed (and illustrated) that the apparatus 1 is of two parts which are located laterally adjacent one another, and of which portions of the two separate bases 2 are illustrated in FIG. 2. Between these two bases 2 there is located a carriage 8 which is shown also in more detail in FIGS. 3 and 4 and which in the illustrated embodiment is composed of two transversely spaced substantially parallel hollow profiled tubular members 9 which are connected at their longitudinally spaced ends by traverse members 10 and 11. It is advantageous but not necessary, if the members 9 are each composed of angle profiles 12 of L-shaped cross section whose arms 13 have been welded or otherwise rigidly connected with one another to form the illustrated polygonal interior cross section, for instance a quadratic or rectangular cross section. The traverse member 10 is located remote from the mine face 20, and the traverse member 11 is located closer to the same. Connected to the traverse member 10 is a free end portion 14 of a piston rod 15 of a hydraulically operable cylinder and piston unit 19 whose cylinder 16 is pivotally connected at **16*a* with the base member 2 (compare FIG. 1). The right-hand end 17 of the carriage 8 can be connected in suitable manner known from the art and only diagrammatically illustrated, with a conveyor 18, which may be a scraper chain conveyor or the like, that extends along the mine face 20 and serves to remove material that has been taken from the mine face. A coal cutting machine or other item of equipment known from the art can be guided on the conveyor 18 in a manner also known from the art, to remove material from the mine face 20.**

Since the right-hand end (in FIG. 1) of the carriage 8 is firmly connected with the conveyor 8, it follows that when the cylinder and piston unit 19 is operated to retract its piston rod 15 from the position shown in FIG. 1, that is to make the piston rod move into the cylinder 16, the entire apparatus will move towards the mine face 20, that is to the right in FIG. 1. This movement can either be towards the conveyor 18, or it can be together with the conveyor 18 further towards the mine face 20. In the latter case, the supporting function of the shield 4 and the cap 5 remains unchanged, because the upward stress exerted upon the shield 4 and the cap 6 continues. In the illustrated embodiment the arrangement is such that when the piston rod 15 is retracted into the cylinder 16, the apparatus 1 will move towards the conveyor 18, but not with the same towards the mine face 20.

Figure 4:
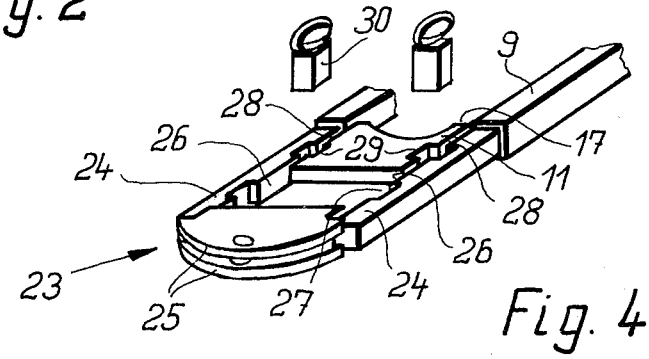
FIG. 4 is a perspective detail view, illustrating a detail of the carriage and extension section in FIG. 1.

Essentially, the apparatus described thus far is known from the prior art. According to the present invention, however, and as shown particularly in FIGS. 2–4, the right-hand free end of the carriage 8 is provided with an extension section which is designated in toto with reference numeral 23. This extension section is formed of two solid cross section bars or similar members 24, each of which is telescopably received in one of the tubular members 9. This is the reason for making the tubular members hollow, whereas in the prior-art constructions they might themselves be of solid cross section. The outer end portions of the members 24, that is the end portions which face towards the right in FIG. 1 and towards the left in FIG. 4, are connected by means of an upper and a lower connecting member 25 having horizontal orientation (compare FIG. 4).

The inwardly directed marginal portions 26 of the members 24 are provided with a plurality of longitudinally spaced recesses 27 of substantially rectangular cross section. The traverse member 11 connecting the elements 9 is provided on its outwardly facing marginal portions 28 with similar recesses 29. It will be evident, and is in any case shown in FIGS. 2 and 4, that when the section 23 is telescoped into or out of the right-hand end of the carriage 8, different ones of the recesses 27 and 29 can be made to be located opposite one another, so as to form with one another openings which in the illustrated embodiment are of substantially quadratic cross section (compare particularly FIG. 2). Once such a position has been selected, that is once the section 23 has been telescoped inwardly or outwardly of the carriage 8 to a greater or lesser extent, the section 23 can be arrested against undesired further movement by inserting an arresting member 30, compare FIG. 4, of a cross section which is substantially mating to that of the openings defined by the oppositely located recesses 27 and 29. This blocks any further movement of the section 23 until the arresting members 30 are again removed. It will be possible to provide the recesses 27 and 29 only at one or the other side of the section 23, but it is preferable to have them on both sides, as illustrated, and to use two of the arresting members 30.

In normal operation, that is when the section 23 is telescoped in and retracted, the forward end 31 of the base member or members 2 (compare FIGS. 1 and 2) will be spaced from the conveyor 18, due to the fact that the section 23 is outwardly extended and substantially bridges the gap between forward end 31 and conveyor 18. If desired, additional connecting members, for example of an elastically yieldable character, can be located between the portions 25 of the section 23 and that side wall 32 of the conveyor 18 which faces towards the carriage 8. The space existing between the portion 31 and the side wall 32 thus makes it possible to carry out any relative movements between the apparatus 1 and the conveyor 18 that might become necessary in operation of the equipment. This is different from the prior art, where the base members would have their forward ends enclosed directly to the conveyor (in order to make joint movement of the apparatus 1 and the conveyor possible), and where movement of the apparatus relative to the conveyor is therefore precluded.

Assuming, for the sake of argument, that during the mining operation it becomes necessary to raise the shield 4 and the cap 6 to a higher level, then the cap 6 will move upwardly but simultaneously leftwardly in FIG. 1, for example to the chain-line position illustrated in that Figure. There will now be a substantial gap between the right-hand end 33 of the cap 6 and the mine face 20, and in this gap the roof 21 will no longer be supported and might break in.

In the prior art it would have been attempted to solve this problem by moving extensions out of the right-hand end 33 of the cap 6, to bridge this gap. The present invention makes this difficult and expensive expedient unnecessary, because it permits the right-hand end of the cap 6 to be moved back to the mine face 20 without such a procedure, simply by removing the arresting members 30 from their openings, telescoping the section 23 further into the carriage 8 and arresting it again when it has been telescoped into the carriage 8 to an extent corresponding essentially to the distance through which the right-hand end 33 of the cap must be moved in order to become located next to the mine face 20 again. Due to this telescoping-in of the section 23 and the carriage 8, it is now possible to move the entire apparatus 1 by operation of the cylinder and piston unit 19, towards the right in FIG. 1 and towards the mine face 20 until the right-hand end 33 of the cap 6 is again located adjacent this mine face. The gap is now bridged and protected against break-in. It may, of course, be necessary to temporarily remove or reduce the upwardly directed stress transmitted by the pit prop 7 to make such advancement possible.

It will be appreciated that the present invention makes it possible to use a simple, very rigid and advantageously one-piece roof supporting cap 6, since no extensions for the cap 6 are required as in the prior art. This makes the construction of the cap 6 much simpler and much less expensive than was previously known, and conversely the additional expenses involved in providing the extension section 23 according to the present invention are very slight as compared to the savings obtained by eliminating the extensions for the cap 6.

Instead of the illustrated configuration for the carriage 8, the latter could also be of one piece and have a hollow box-shaped profile, in which case the section 23 might be constructed as illustrated or it might be constructed in an appropriately modified version. The illustrated embodiment has the advantage of having a great resistance to bending and twisting forces, but at the same time having much lower weight than a one-piece carriage, a factor which is important in terms of erecting, knocking down and transporting such equipment underground. It will be appreciated that the cross-sectional configuration in the interior of the members 9 need not be as shown, but that it could be generally polygonal including quadratic, rectangular or the like.

No attempt has been made to show fluid connections for the pit prop 7 and the cylinder and piston unit 19, because this is well within the skill of those conversant with the art.

It will be understood that each of the elements described above, or two or more together, may also find a useful application in other types of constructions differing from the type described above.

While the invention has been illustrated and described as embodied in an apparatus for preventing cave-ins of underground excavations, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an apparatus for supporting a roof of an underground excavation, a combination comprising floor-engaging means; conveyor means closer to the face of the excavation than said floor-engaging means; means for alternately advancing said floor-engaging means and said conveyor means toward said face, as the same recedes exposing portions of the floor and the roof of the excavation, in steps of a predetermined length; roof-engaging means mounted on said floor-engaging means for pivoting about a substantially horizontal axis and extending above said conveyor means toward said face, said roof-engaging means having a front portion adjacent said face and spaced therefrom by a distance which depends on the inclination of said roof-engaging means; and means for minimizing said distance so as to prevent the roof above said conveyor means for caving in, said minimizing means including a carriage section mounted on said floor-engaging means for shifting relatively thereto toward and away from said face and having an end facing the latter, an extension section in the region of said end and connected to said conveyor means, one of said sections being mounted on the other section for telescopic movement with respect thereto whereby the spacing between said floor-engaging means and said conveyor means is adjusted so as to minimize said distance independently of said advancement, and means for arresting said one section in a plurality of positions relative to said other section so as to form a unit therewith during said advancement of said floor-engaging and conveyor means.

2. In an apparatus as defined in claim 1, wherein said floor-engaging means has one end portion closer to and another end portion farther from said face, and wherein said shield means comprises a roof-engaging element pivoted to said other end portion and extending above said floor-engaging means in direction of said one end portion, and a roof supporting cap member pivoted to a free edge region of said shield element.

3. In an apparatus as defined in claim 2, wherein said advancing means comprises a fluid-operated cylinder and piston unit having a first terminal portion in the region of said other end portion to bear against an abutment, and a second terminal portion connected with said floor-engaging means.

4. In an apparatus as defined in claim 3, wherein said carriage section has a further end spaced from the first-mentioned end and connected with said first terminal portion of said cylinder and piston unit.

5. In an apparatus as defined in claim 2, wherein said floor-engaging means comprises two base sections located at opposite sides of said carriage section.

6. In an apparatus as defined in claim 2, wherein said carriage section is at least in part of hollow box-shaped configuration; and wherein said extension section has an outer cross section at least substantially corresponding to the inner cross section of said part.

7. In an apparatus as defined in claim 2, wherein said carriage section comprises a pair of rigidly connected transversely spaced and at least substantially parallel tubular members of polygonal inner cross section having open ends, and said extension section comprises a pair of connected solid cross section elements each of which is telescopable into and out of one of said tubular members.

8. In an apparatus as defined in claim 7, said carriage section having in the region of said end thereof a transversely extending connecting member which connects said tubular members and has a first set of marginal portions extending forwardly of said open ends and facing inwardly of the respective inner cross section, said solid cross section elements having a second set of marginal portions which face the marginal portions of said first set; and wherein said arresting means comprises a plurality of longitudinally spaced first recesses in the marginal portions of one of said sets, and secone recesses provided in the marginal portions of the other set and adapted to be positioned opposite respective ones of said first recesses to define a composite opening therewith.

9. In an apparatus as defined in claim 7, wherein each of said tubular members is composed of a pair of elongated angle profiles of L-shaped cross section which are rigidly connected to form a polygonal cross section.

10. In an apparatus for preventing cave-in of mining galleries and other underground excavations which includes base means having one end portion closer to and another end portion farther from a face of the excavation, roof support shield means on said base means and extending above the same toward said face and including a shield element pivoted to said other end portion and extending above said base means in direction of said one end portion, and a roof supporting cap member pivoted to a free edge region of said shield element, and advancing means including a shiftable carriage moveable with said base means towards and away from said face and having an end directed toward the latter, said carriage comprising a pair of rigidly connected transversely spaced and at least substantially parallel tubular members of polygonal inner cross section having open ends, and a transversely extending connecting member in the region of said end thereof which connects said tubular members and has a first set of marginal portions extending forwardly of said open ends and facing inwardly of the respective inner cross section, an improvement comprising an extension section telescopable into and out of said end and including a pair of connected solid cross section elements each of which is telescopable into and out of one of said tubular members, said solid cross section elements having a second set of marginal portions which face said marginal portions of said first set; and arresting means for arresting said extension section in a plurality of different telescoped positions, said arresting means including a plurality of longitudinally spaced first recesses in the marginal portions of one of said sets, and second recesses provided in the marginal portions of the other set and adapted to be positioned opposite respective ones of said first recesses to define a composite opening therewith, and at least one arresting member of a cross section substantially corresponding to that of said composite opening and insertable into the latter.

11. In an apparatus for preventing cave-in of an underground excavation, a combination comprising base means; a carriage section mounted on said base means for movement relative thereto towards and away from a face of the excavation and having an end directed toward said face; an extension section in the region of said end, one of said sections being mounted on the other section for telescopic movement with respect thereto; and arresting means for arresting said one section in a selected one of a plurality of different positions relative to said other section, said arresting means including a plurality of spaced recesses in said carriage section and said extension section, said recesses being adapted to be positioned opposite one another to define a composite opening in each of said positions, and an arresting member insertable into said composite opening to arrest said sections in said selected position relative to one another.

* * * * *